United States Patent [19]

Nicholson

[11] 3,993,305

[45] Nov. 23, 1976

[54] POCKET BILLIARD TRAINING BALL AND METHOD OF TEACHING SIGHTING WHEN PLAYING POCKET BILLIARD

[75] Inventor: Donald A. Nicholson, Hanson, Mass.

[73] Assignee: Anthony M. Lorusso, Scituate, Mass.

[22] Filed: May 9, 1975

[21] Appl. No.: 576,041

[52] U.S. Cl. ..... 273/2; 273/59 R; D34/15 EE

[51] Int. Cl.[2] ..... A63B 37/00

[58] Field of Search ..... 273/2, 14, 58 R, 58 A, 273/59, 63 C; D34/3, 15 EE

[56] References Cited

UNITED STATES PATENTS

| | | | |
|---|---|---|---|
| 278,341 | 5/1883 | Kelly | 273/2 UX |
| 280,807 | 7/1883 | Farley | 273/58 R |
| 666,333 | 1/1901 | Stevens | 273/59 R |
| 984,463 | 2/1911 | Beltran | 273/59 R |
| 3,318,598 | 5/1967 | Ruskin | 273/63 C |
| 3,411,779 | 11/1968 | McGowan | 273/2 |
| D33,124 | 8/1900 | Newell | D34/15 EE |

FOREIGN PATENTS OR APPLICATIONS

| | | | |
|---|---|---|---|
| 14,495 | 12/1903 | Austria | 273/2 |

*Primary Examiner*—Paul E. Shapiro
*Attorney, Agent, or Firm*—Kenway & Jenney

[57] ABSTRACT

A training object ball for use in teaching billiard players to sight an object ball by the method known as "sighting by object ball displacement". The training ball is segmented at 30° intervals to yield twelve legended segments which facilitate lining up one edge of a cue ball with the edge of the area of the training ball displaced by the cue ball.

The method of training players to sight by object ball displacement includes the step of orienting the training ball so that an imaginary line extending from the center of the ball and through the boundary of two adjoining segments bisects the pocket to be made. An edge of the cue ball is lined up with a properly oriented segment boundary which corresponds to the edge of the area of the training ball that is displaced by the cue ball.

Instructions for lining up a segment boundary which corresponds to the edge of the displaced area of the object ball with an edge of the cue ball is also disclosed.

In the preferred embodiment of the invention, the training ball is segmented to enable the shooter to determine the correct contact point and also hit that contact point by "object ball displacement" sighting. The training ball of the present invention, however, can be employed to great advantage simply to determine the proper contact point and the shooter can, if he wishes, aim the cue ball directly at that contact point. Thus, for its broadest application the training ball need only be legended or marked sufficiently to enable the shooter to determine the correct contact point. Thus, the training ball need only include a visible line, arrow, or ring about any circumference or be colored to divide the training ball into two contrasting hemispheres.

9 Claims, 8 Drawing Figures

POCKET BILLIARD TRAINING BALL AND METHOD OF TEACHING SIGHTING WHEN PLAYING POCKET BILLIARD

BACKGROUND OF THE INVENTION

The present invention is a novel object ball for use in the game of pocket billiard and a method of using the training ball and a method of instructing a person how to sight and aim a cue ball through the aid of the novel pocket billiard training ball which serves as the object ball.

In the game of pocket billards, an object ball 10 is struck by a cue ball 12 which is propelled toward the object ball by the force of a cue stick 14. The purpose of the game is to sink the object ball 10 into a pocket, such as pocket 16, without sinking the cue ball 12 in any pocket on the billiard table.

It is well known that an object ball travels along a straight line originating at the point where the cue ball contacts the object ball and extending through the center of the object ball. In view of this fact, players of pocket billiards picture an imaginary line (represented in FIG. 1 by arrow 18) from the center of the pocket through the center of the object ball. The termination point 20 of imaginary line 18 is the point that the cue ball should contact in order to make pocket 16. For example, if cue ball 12 contacts object ball 10 at point 20 along imaginary line 18, object ball 10 will travel toward pocket 16 along that imaginary line 18. It makes no difference where the ball 12 is located on the table, so long as the cue ball can make good contact at point 20. If good contact is made by the cue ball at point 20 on the object ball, object ball 10 will travel along line 18.

Unfortunately, aiming the cue ball 12 so that it strikes the termination of the imaginary line that bisects the object ball and the pocket to be made is difficult because the shooter cannot easily see the point of contact when he is positioned low behind the cue ball. It should be apparent that the cue ball blocks out or eclipses the point of contact desired when the head of the shooter is low and behind the cue ball.

As a result, billiard players have developed various methods of sighting the correct contact point on the object ball. One common method of sighting is the method known as sighting by object ball displacement. This method of sighting is shown schematically in FIG. 2. Basically, a player aims at the point of contact by lining up one edge of the cue ball with the corresponding edge of the hidden area of the object ball that is obstructed from the shooter by the cue ball.

FIG. 2 shows four shots that can be made by using this method of sighting by object ball displacement. One shot is the shot known as a "full-ball" shot and is shown schematically in FIG. 2 by cue ball 22 striking object ball 24 and sending it on into pocket 26. Each of the other three shots are described in reference to sinking an object ball into pocket 26. In FIG. 2 the hidden area of the object ball that is eclipsed from the shooter by the cue ball is cross-hatched or shaded.

In order to make a full-ball shot, the shooter lines up the edge of the cue ball 22 with the edge of object ball 24 as is shown by sight line 28. To make a "three-quarter ball" shot, the shooter lines up the edge of cue ball 30 so that one edge will be in line with the edge 32 of the hidden area 34 of object ball 36. This is shown schematically by sight line 38. By aiming the cue ball in this manner, the cue ball will strike object ball 36 at contact point 40 which is the end of an imaginary line bisecting the object ball and pocket 26.

A "half-ball" shot is made in a similar manner. Here the shooter lines up an edge of cue ball 42 so that an edge is in line with the corresponding edge of the hidden area of the object ball 44, as is shown by sight line 46. To make a "one-quarter ball" shot, the shooter sights along sight line 48 so that the edge of cue ball 50 is in line with the edge of the one-quarter area of the object ball 52 which is obstructed from the shooter's vision by the cue ball 50. A "thin ball" shot is also made in a similar manner by sighting along sight line 54 so that the edge of cue ball 56 is in line with the edge of the thin hidden area. At this point, it should be noted that the terms thin ball, etc. describe the portion of the object ball that is hidden or obstructed from the shooter's vision by the cue ball. Thus, with a full ball shot, the complete object ball is eclipsed by the cue ball; whereas, in a three-quarter ball shot, three quarters of the object ball is obstructed or eclipsed by the cue ball.

The foregoing method of sighting the cue ball is difficult for the beginner to master and understand because he has difficulty in determining the exact position of the edge of the hidden area of the object ball.

SUMMARY OF THE INVENTION

The exact position of the edge of the area of the object ball that is eclipsed by the cue ball is easily determined when the preferred embodiment of the object ball of the present invention is utilized because the object ball contains twelve legended segments which, when properly oriented with respect to a pocket to be made, indicate the boundary of the eclipsed area and facilitate sighting by object ball displacement.

For its broadest application, the object ball of the present invention need only be used to determine the correct contact point. In this case, the training ball contains a legend in the form of an arrow, line or band about any circumference or is divided into two hemispheres of opposite color. In use, the training ball is oriented so that an imaginary line extending through the boundary between the hemispheres or the legend and the center of the ball bisects the pocket to be made. With the ball oriented in this manner, the cue ball is aimed at the legend or boundary.

Accordingly, it is an object of the present invention to provide a pocket billiard object ball which contains legended segments which when properly oriented enable a shooter to determine the imaginary line from the center of the ball to the pocket to be made and which also enables the shooter to determine the edge of the area of the object ball that is displaced by the cue ball to facilitate sighting by object ball displacement.

A further object of the present invention is to provide a novel method of training a billiard player to sight by the technique known as sighting object ball displacement.

Another object of the present invention is to provide a pocket billiard object ball and method for using this ball in which the object ball contains a means to enable a shooter to determine the imaginary line from the correct contact point through the center of the ball to the pocket to be made and which also facilitates the shooters ability to strike the correct contact point on the object ball.

DESCRIPTION OF THE PREFERRED EMBODIMENTS

Figure 3:
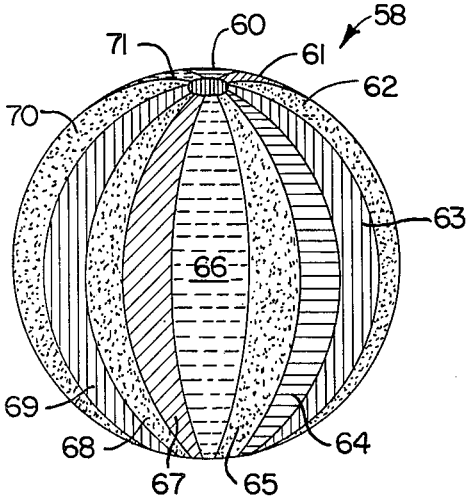
FIG. 3 is a view of an object ball in accordance with the present invention.
Figure 4:
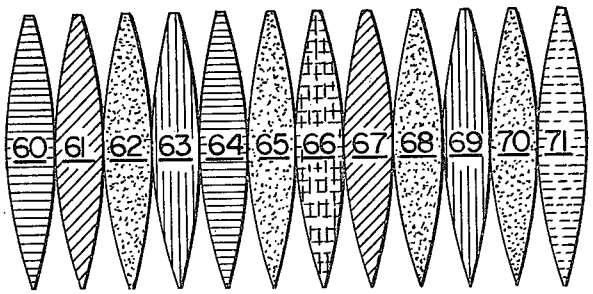
FIG. 4 is a diagramatic projection into a single plane of legended segments of the object ball of FIG. 3.

At the outset, the present invention is described in its broadest overall aspects with a more detailed description following. As is shown in FIGS. 3 and 4, in one important embodiment of the invention, the object ball 58 has various legended segments 60–71 formed thereon. In the preferred embodiment of the invention there are twelve segments which can be thought of as being formed by meridians that are spaced apart 30° and extending between the poles of the ball 58. These segments may be formed on the ball in the conventional manner that is used to number and color conventional object balls used in pocket billiards. The ball itself would be of conventional size; that is, 2⅛ inches in diameter or 2¼ inches in diameter. Each segment 60–71 may have an individual distinctive color, although this is not absolutely necessary. Indeed, bordering segments may be alternately colored with two contrasting colors such as black and white. It is also advantageous, but not necessary, that the top of the ball contain a dot 74 of approximately 3/16 inch diameter. Of course, a dot may be positioned on both the top and bottom of the ball; but, since only the top dot is seen when the ball is properly oriented, only one dot is useful.

As is set forth above, in the preferred embodiment there are twelve segments which are spaced apart by an angle of 30°. As will become more apparent from the discussion which follows, the preferred embodiment of the object training ball of the present invention is so divided to facilitate sighting by the method of object ball displacement. The reason why twelve segments separated by meridians spaced apart 30° are preferred is that this arrangement is geometrically compatible with the geometry of a billiard table. In connection with the foregoing, a billiard table is a rectangle in which the longest dimensions are twice the size of the shortest dimensions. Thus, if the billiard table were bisected by a line extending through the centers of the side pockets (pocket C and D in FIG. 6) the result would be a square with the foot spot being located at the exact geometric center of that square. Thus, the angle between one pocket, the foot spot and any adjoining pocket is 90°. For example, the angle between pocket A, the foot spot and pocket B is 90°. The angle between pocket A, the foot spot and pocket D is 90°. The angle between pocket D, the foot spot and pocket C is 90°.

By having the meridians that form the segments separated by an angle that is a multiple of 90°, a larger variety of shots can be taught with the training ball. Thus, the invention is not intended to be limited to a training ball having twelve segments separated by a 30° angle. Indeed, as will be more apparent from the discussion which follows, the training ball of the present invention need not include any segments; but, can simply have an arrow or a band imprinted on its circumference in such a way so that the imaginary line extending from the pocket to be made, the center of the ball and the contact point can be easily determined. Of course, the ball could also contain more than twelve segments.

Figure 5:
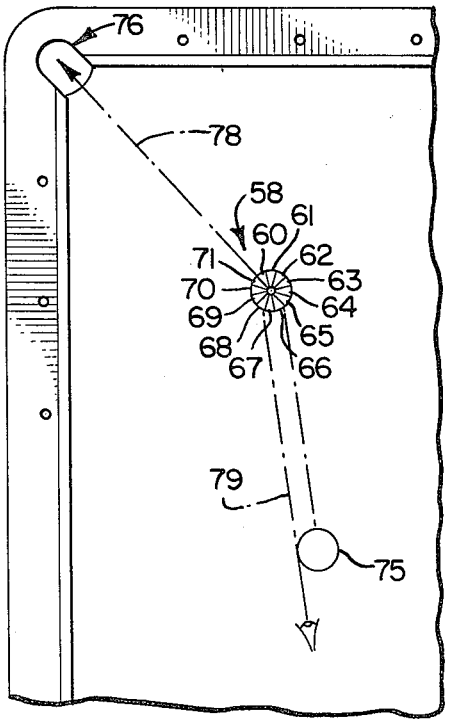
FIG. 5 is a diagram illustrating a method of using the object ball of FIG. 3.
Figure 6:
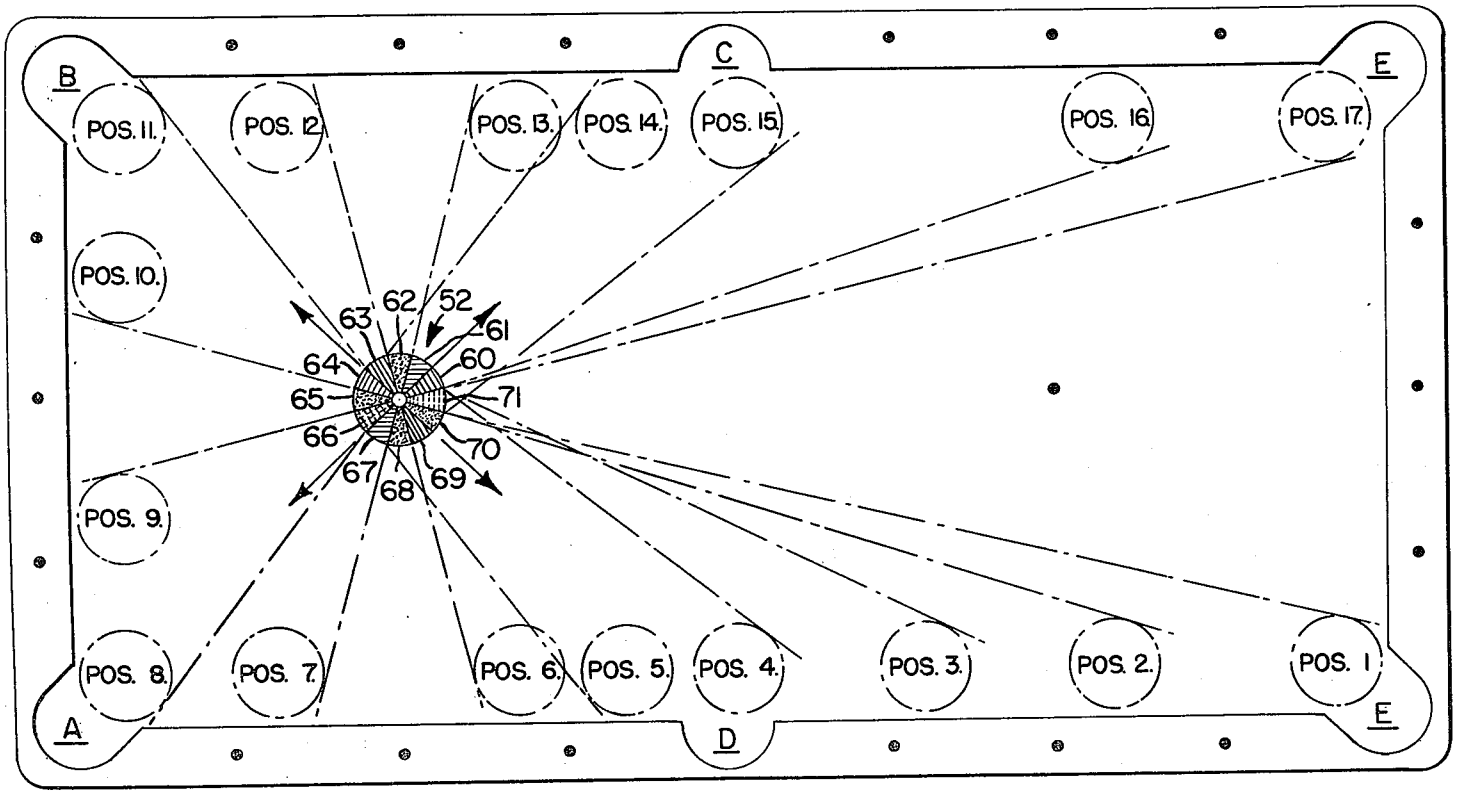
FIG. 6 is another diagram illustrating how various shots are made with the object ball of the present invention.

As is stated above, the purpose of the training ball is to use it as an aid for practicing various pocket billiard shots. When in use, the ball is oriented by the shooter in a certain way for a particular shot. More specifically, the training ball 58 is oriented so that the dot 74 is positioned on the top of the ball as is shown in FIGS. 5 and 6. The ball is then rotated about its axis to line up a meridian between adjoining legended segments with the pocket to be made. Once the ball is properly oriented, a shot from full hit dead center to thin cut can be made by aiming an edge of the cue ball at the meridian of an appropriate legended segment. Bank shots, kiss shots and combination shots can also be made by aiming the cue ball at the appropriate legended segment after the ball has been properly oriented.

An example of how the training ball is used is shown in FIG. 5. With the training ball 58 and the cue ball 75 positioned on the billiard table as is shown in FIG. 5, pocket 76 can be made in the following manner. First the object ball 58 is positioned with dot 74 up. Thereafter, the ball 58 is rotated, if necessary, about its axis so that adjoining legended segments are in line with an imaginary line 78 drawn from the center of pocket 76 through the center of the object ball as is shown in FIG. 5. It is now apparent to the shooter that the correct contact point on the object ball to make pocket 76 lies on the boundary of segments 65 and 66. As long as cue ball 75 strikes object ball 58 at the meridian separating segments 65 and 66, it will travel along imaginary line 78 into pocket 76.

The next point for the shooter to consider is how to aim cue ball 75 so that it will strike training ball 58 at the termination of imaginary line 78 which is along the meridian separating segments 65 and 66. With cue ball 75 in the position on the table as is shown in FIG. 5, in order to sight by the method of object ball displacement, the shooter would sight along the left side of the cue ball as is shown by sight line 79 so that the left edge of the cue ball will travel along line 79 towards the left edge of the area of the object ball displaced by the cue ball. With the orientation shown in FIG. 5, the shooter would sight the left side of the cue ball so that it travels in a line toward the boundary of segments 67 and 68.

In other words, the shooter sights the left side of cue ball 75 so that when the cue ball travels toward the object ball 58, the left side of the cue ball is constantly in line with the boundary between segments 67 and 68. It should be noted that segment 67 is hidden from the shooter's view by cue ball 75; whereas, segment 68 is visible. Thus, the shooter can aim the cue ball in a way that segment 67 is hidden and segment 68 is visible.

As has been set forth above, the training ball of the present invention is a valuable tool for training a shooter to shoot any number of possible shots when playing pocket billiard. A representative sampling of shots which can be taught in accordance with the present invention are shown in FIG. 6. For each shot the object ball 58 is rotated until the meridian between any two segments align with the pocket to be made.

In FIG. 6, the circles mark positions, i.e. "pos 1", 2, etc., which represents various places on the table that a cue ball might be located at during a game. In order to facilitate the description of the invention, the object ball 58 is shown positioned on the foot spot.

Position 1 — for pocket B, align players right side of cue ball to split ball 58 between segments 70 and 71.

Position 2 — for pocket B, align players right side of cue ball to split ball 58 between segments 70 and 71.

Position 3 — for pocket B, align players right side of cue ball to split ball 58 between segments 60 and 71.

Position 4 — for pocket B, align players right side of cue ball to split ball 58 between segments 60 and 71.

Position 5 — for pocket B, align players left side of cue ball to split ball 58 between segments 67 and 68.

Position 6 — for pocket B, align players left side of cue ball to split ball 58 between segments 68 and 69.

Position 7 — for pocket C, align players right side of cue ball to split ball 58 between segments 67 and 68.

Position 8 — for pocket C, align players right side of cue ball to split ball 58 between segments 66 and 67.

Position 9 — for pocket C, align players left side of cue ball to split ball 58 between segments 65 and 66.

Position 10 — for pocket D, align players right side of cue ball to split ball 58 between segments 64 and 65.

Position 11 — for pocket D, align players right side of cue ball to split ball 58 between segments 63 and 64.

Position 12 — for pocket D, align players left side of cue ball to split ball 58 between segments 62 and 63.

Position 13 — for pocket A, align players right side of cue ball to split ball 58 between segments 61 and 62.

Position 14 — for pocket A, align players right side of cue ball to split ball 58 between segments 62 and 63.

Position 15 — for pocket A, align players left side of cue ball to split ball 58 between segments 71 and 70.

Position 16 — for pocket A, align players left side of cue ball to split ball 58 between segments 60 and 71.

Position 17 — for pocket A, align players left side of cue ball to split ball 58 between segments 60 and 71.

Figure 8:
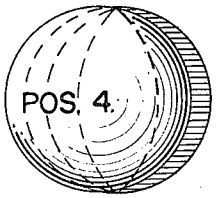
Figure 7:
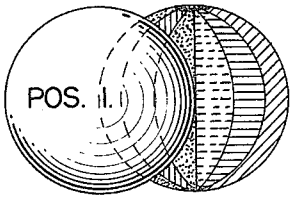
FIG. 7 is a diagram illustrating the relative position of the cue ball and object ball as seen by the shooter for a position No. 1 shot of FIG. 6; and, FIG. 8 is a diagram illustrating the relative position of the cue ball and the object ball as seen by the shooter for a position No. 4 shot of FIG. 6.

FIG. 7 is a diagram illustrating the relative position of the cue ball and object ball as seen by the shooter for a position No. 1 shot in FIG. 6 and FIG. 8 is a diagram illustrating the relative position of the cue ball and object ball as seen by the shooter for a position No. 4 shot of FIG. 6.

The foregoing discussion relative to FIG. 6 is merely illustrative of different shots that can be made when the object ball of the present invention is on the foot spot. With an object ball such as the one shown in FIG. 3, it is possible to diagram other shots that can be made when the object ball is in other positions on the billiard table.

Figure 1:
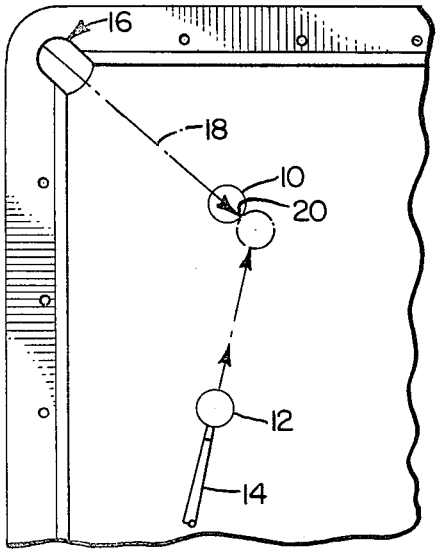
FIG. 1 is a diagram illustrating how an object ball travels when struck by a cue ball.
Figure 2:
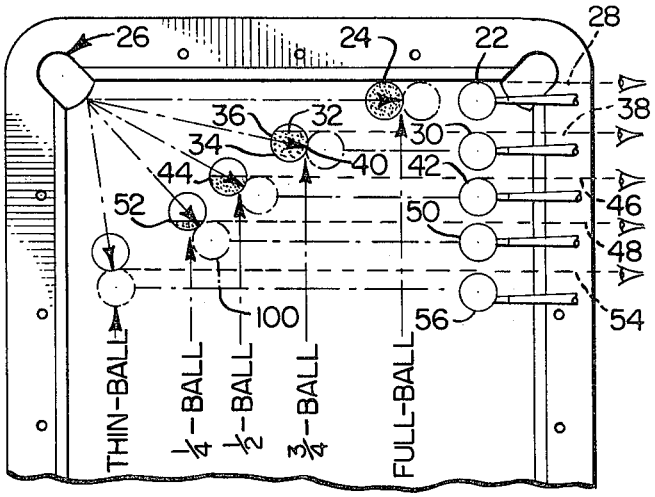
FIG. 2 is a diagram illustrating a method of sighting known as sighting by object ball displacement.

One method that can be used to great advantage in order to make various shots includes the use of a third ball that is placed tangentially to the object ball at the correct contact point. By dropping a third ball in such a position the shooter can readily determine the correct segment to aim at when shooting by object ball displacement. To further illustrate this technique, reference is made to FIG. 2 in which cue ball 50 strikes object ball 52. In accordance with the present invention, the training ball, which would be in the position shown by ball 52, is oriented so that the plane of any segment boundary bisects pocket 26. Once properly oriented, the end of the segment boundary on the ball furthest away from pocket 26 would be the correct contact point. A third ball 100 is then dropped into place so that it makes contact at the head of the arrow on ball 52. The shooter can now readily visualize where cue ball 50 should end up in order to make pocket 26. If a ball such as the one shown in FIG. 3 is utilized as object ball 52 then the shooter can orient the ball so that a segment boundary is along sight line 48. On the other hand, if the shooter prefers to sight by aiming directly at the contact point he at least has a better idea of where the cue ball 50 should end up.

It is again emphasized that the object ball of the present invention in its broadest application need only to be marked sufficiently so as to enable the shooter to locate the imaginary line that extends through the center of the ball and the pocket to be made. This can be accomplished with as few as two segments in the form of a hemisphere. Of course, the ball may simply have an arrow formed on an arc of the training ball's circumference so that the head of the arrow can be pointed toward the pocket to be made with the tail of the arrow indicating the correct contact point. Bands, rings, etc. can be utilized in a similar fashion. Thus, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of the equivalency of the claims are therefore intended to be embraced therein.

I claim:

1. A method of enabling a billiard player to improve his game of pocket billiards comprising the following steps:

a. providing a pocket billiard training ball having a legend formed thereon at least one portion of which when properly oriented on a billiard table lies along an imaginary line which bisects a selected pocket and another portion of which indicates the correct contact point that a cue ball must strike in order to make the selected pocket when one portion of the legend is oriented to lie along an imaginary line which bisects a selected pocket;

b. orienting the training ball so that an imaginary line extending from the center of the training ball and through one portion of the legend bisects the pocket to be made;

c. aiming the cue ball so that the cue ball will strike the portion of the oriented legend which indicates the correct contact point; and, d. shooting the cue ball to contact the portion of the oriented legend which indicates the correct contact point.

2. The method as set forth in claim 1 wherein in step (a) a pocket billiard training ball is provided which has a legend inclusive of a plurality of segments separated by boundaries which form an angle with adjacent segment boundaries which angle is a factor of 90°, and wherein in step (b) a segment boundary is oriented with a pocket to be made, enabling a shooter to determine the termination point of an imaginary line extending from the pocket to be made through the center of the training ball.

3. The method as set forth in claim 2 wherein in step (c) an edge of the cue ball is aimed at a segment boundary which corresponds to the edge of the area of the training ball displaced by the cue ball.

4. The method as set forth in claim 2 wherein in step (c) the ball is aimed to contact a segment boundary which is opposite to and in line with the segment boundary oriented with the pocket to be made.

5. The method as set forth in claim 1 wherein in step (a) a pocket billiard training ball containing twelve segments formed by boundaries separated by an angle of 30° is provided, and wherein step (b) the training ball is oriented so that the imaginary line passes through segment boundaries and wherein step (c) an edge of the cue ball is aimed at a segment boundary which corresponds to the edge of the area of the training ball displaced by the cue ball.

6. The method as set forth in claim 5 wherein the cue ball contacts a segment boundary which is opposite to and in line with the segment boundary oriented with the pocket to be made.

7. The method as set forth in claim 1 wherein in step (a) a training ball is provided having an arrow formed thereon and wherein in step (b) the training ball is oriented so that an imaginary line extending along the arrow bisects the pocket to be made and wherein in step (c) the cue ball is aimed so that the cue ball will strike the end of the arrow opposite the pocket to be made.

8. The method as set forth in claim 1 wherein in step (a) a training ball is provided having a band formed thereon and wherein in step (b) the training ball is oriented so that an imaginary line extending along the band bisects the pocket to be made and wherein in step (c) the cue ball is aimed so that the cue ball will strike the portion of the band opposite the pocket to be made.

9. A pocket billiard training ball for use in enabling a billiard player to aim a cue ball at the correct contact point to make a selected pocket on a billiard table comprising a billiard ball having a legend thereon said legend being inclusive of twelve segments formed by boundaries separated by an angle 30°, each segment boundary being capable of being oriented so that when placed on a billiard table it lies along an imaginary line which bisects the selected pocket while a segment boundary opposite to and in line with the segment lying along the imaginary line bisecting the pocket to be made indicates the correct contact point that a cue ball must strike in order to make the selected pocket, other segments forming said legend enabling a player to strike the correct contact point on the training ball with the cue ball by object ball displacement by facilitating the shooter's ability to locate an edge of the cue ball which corresponds to the edge of the area of the training ball displaced by the cue ball.

* * * * *